US008782868B2

(12) United States Patent
White

(10) Patent No.: US 8,782,868 B2
(45) Date of Patent: Jul. 22, 2014

(54) REMOVABLE EXTENSION FOR A RETAINING RING

(76) Inventor: Chad Singleton White, Syracuse, UT (US)

( * ) Notice: Subject to any disclaimer, the term of this patent is extended or adjusted under 35 U.S.C. 154(b) by 589 days.

(21) Appl. No.: 13/006,953

(22) Filed: Jan. 14, 2011

(65) Prior Publication Data

US 2011/0173795 A1 Jul. 21, 2011

Related U.S. Application Data

(60) Provisional application No. 61/296,399, filed on Jan. 19, 2010.

(51) Int. Cl.
*B23P 17/00* (2006.01)

(52) U.S. Cl.
USPC ..... 29/418; 24/3.6; 70/453

(58) Field of Classification Search
USPC ..... 29/418; 70/43, 454, 456 R, 453, 457, 70/458; 24/3.6, 67.9, 566
See application file for complete search history.

(56) References Cited

U.S. PATENT DOCUMENTS

| | | | | | |
|---|---|---|---|---|---|
| 159,403 | A | * | 2/1875 | Foster | 24/598.6 |
| 872,934 | A | * | 12/1907 | Harig | 43/42.74 |
| 1,264,379 | A | * | 4/1918 | Doering | 24/697.2 |
| 2,019,691 | A | * | 11/1935 | Morehouse | 24/601.1 |
| 2,871,540 | A | * | 2/1959 | Smith | 24/600.9 |
| 3,122,803 | A | * | 3/1964 | Boggess et al. | 24/373 |
| 3,315,504 | A | * | 4/1967 | Billings, Jr. | 70/408 |
| 4,325,273 | A | * | 4/1982 | Gibbons | 81/485 |
| 4,422,315 | A | * | 12/1983 | Klose | 70/456 R |
| 4,426,854 | A | * | 1/1984 | Geldwerth et al. | 63/4 |
| 4,543,860 | A | * | 10/1985 | Van Meter | 81/488 |
| 4,658,822 | A | * | 4/1987 | Kees, Jr. | 606/158 |
| 4,660,558 | A | * | 4/1987 | Kees, Jr. | 606/158 |
| 4,924,618 | A | * | 5/1990 | McGahee | 43/43.6 |
| D312,982 | S | * | 12/1990 | Moodley | D11/87 |
| 5,367,896 | A | * | 11/1994 | Sundberg | 70/457 |
| 5,465,596 | A | * | 11/1995 | Park | 70/458 |
| 5,915,946 | A | * | 6/1999 | Nakajima | 43/44.86 |
| 5,934,123 | A | * | 8/1999 | Eldredge | 70/456 R |
| 6,836,996 | B1 | * | 1/2005 | Huppert | 43/42.39 |

* cited by examiner

*Primary Examiner* — David Bryant
*Assistant Examiner* — Bayan Salone
(74) *Attorney, Agent, or Firm* — Keller Jolley Preece

(57) ABSTRACT

A retaining ring includes: a resilient material forming a loop comprising a first end and a second end, wherein the first end of the loop has a notch through a portion of a thickness of the material; a removable extension at the second end extending from the notch, wherein the removable extension is configured to break away from the first end at the notch with an applied force to the removable extension.

20 Claims, 5 Drawing Sheets

REMOVABLE EXTENSION FOR A RETAINING RING

CROSS-REFERENCE TO RELATED APPLICATION

The present application claims priority under 35 U.S.C. §119(e) from previous U.S. Provisional Patent Application No. 61/296,399 by Chad White entitled, "Removable extension for a retaining ring" filed Jan. 19, 2010, which provisional application is hereby incorporated by reference in its entirety.

BACKGROUND

Split retaining rings, or split rings, are frequently used to retain items in a secure manner. Split rings may be used to group similar items together. For example, split rings are often used to retain keys grouped together. Split rings may also be used in the coupling of certain products, such as fishing hooks and lures. Additionally, split rings may be used for items such as needles.

Many split rings are constructed with tight junctions or overlapping portions that help retain the items place on the split rings. This may prevent items from accidentally falling off or detaching from the split rings. Because of the tight junctions or overlapping portions, however, it can be surprisingly difficult to put materials onto split rings. Also, as in the case of fishing lures and crafts such as jewelry making, some split rings are very small, which makes putting materials onto split rings even more difficult.

SUMMARY

Embodiments of an apparatus are described. In one embodiment, the apparatus is a retaining ring. The retaining ring includes: a resilient material forming a loop having a first end and a second end, wherein the first end of the loop has a notch through a portion of a thickness of the material; a removable extension at the second end extending from the notch, wherein the removable extension is configured to break away from the first end at the notch with an applied force to the removable extension. Other embodiments of the apparatus are also described.

Embodiments of a method are also described. In one embodiment, the method is a method for inserting items onto or removing items from a retaining ring; providing a retaining ring, wherein the retaining ring includes: a resilient flexible material forming a loop having a first end and a second end, wherein the second end of the loop has a notch through a portion of a thickness of the material; and a removable extension at the second end extending from the notch; passing materials through the loop via the removable extension at the first end; and removing the removable extension from the first end at the notch with an applied force to the removable extension. Other embodiments of the method are also described.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
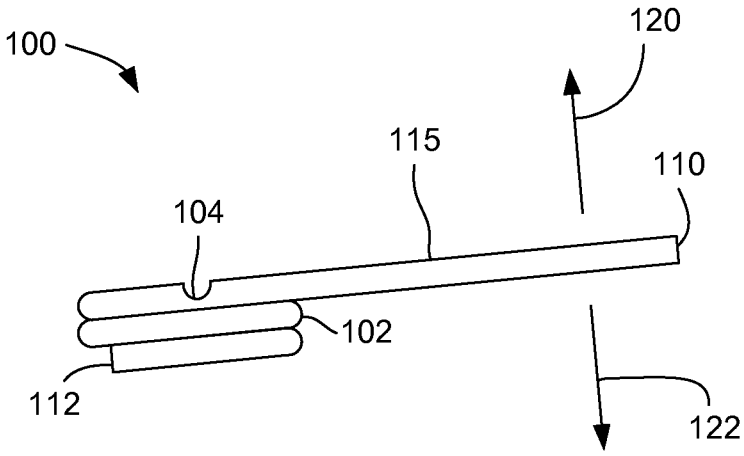
FIG. 1 depicts an illustrative diagram of one embodiment of a retaining ring, according to principles described herein.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments present a split retaining ring, also referred to herein as a split ring or a retaining ring, for retaining materials. More particularly, the present specification relates to a removable extension for a retaining ring that allows for easier insertion of materials onto the retaining ring.

Retaining rings are designed to retain items on the rings, and as a consequence, inserting items onto the retaining rings may be difficult. Conventional retaining rings sometimes require split ring pliers or other tools to insert items on the retaining rings because junctions or overlapping portions of the retaining ring require a large amount of force to create a gap through which items may be inserted.

Because it may be difficult to put materials onto a conventional split ring, a split ring with a removable extension allows for easier insertion of materials or items onto the retaining ring. The removable extension may be removed by breaking the extension off of the split ring at a notch in the ring, producing a retaining ring that is essentially identical to a conventional retaining ring. The removable extension may allow materials to be placed onto the retaining ring without the use of tools such as split ring pliers.

FIG. 1 depicts an illustrative diagram of one embodiment of a retaining ring 100, according to principles described herein. Retaining rings 100 may come in varying sizes and shapes. Generally, retaining rings 100 include one or more loops 102 of material that is both resilient and flexible for the purpose of allowing items to be placed on the retaining rings 100 while also preventing accidental removal of the items from the retaining rings 100. Many retaining rings 100 are made of metal, though they may alternatively be made of other materials that achieve the same or similar results, including polymers and/or other materials.

In one embodiment, the retaining ring 100 includes multiple loops 102 formed between first and second ends 110, 112. As described herein and in the appended claims, the terms "first end" and "second end" may be used interchangeably to refer to the ends of a retaining ring 100, such that neither term is limited to describing the same end of the retaining ring 100 in all embodiments. The retaining ring 100 may include any number of loops 102 formed between the first and second ends 110, 112, depending on the determined use for the retaining ring 100. Most retaining rings 100, such as key rings, have two loops 102 or slightly less than (see FIG. 4) two loops 102. Inserting items onto a retaining ring 100 with two loops 102 generally requires that the item be inserted onto one end of the retaining ring 100 and pushed onto the ring 100 through about one loop 102 before the item is fully inserted onto the retaining ring 100.

Because retaining rings 100 are generally made using a resilient material, such as metal, creating a gap between the loops 102 or ends of a single loop 102 large enough for an item to pass through can be difficult. For example, a portion of a key that needs to pass through the gap for the key to be inserted onto the retaining ring 100 may be thick, and therefore the retaining ring 100 may require a substantial amount of force to create a large enough gap for the key portion, and may be difficult without the aid of a tool, particularly if the retaining ring 100 includes a thick material.

In one embodiment, the first end 110 of the retaining ring 100 includes a removable extension 115 that extends outward from the loop 102 at a notch in the first end 110. The removable extension 115 may allow easier insertion of items onto the retaining ring 100 because the items may first be placed over the removable extension 115 and pushed onto the retaining ring 100, instead of attempting to create a gap through which the items may pass using a non-extended end of the retaining ring 100.

The retaining ring 100 includes a notch 104 at the first end 110 at a base of the removable extension 115 begins. In one embodiment, the notch 104 is a groove through at least a portion or thickness of the metal or material making up the retaining ring 100. The notch 104 may be placed on one or more planes of the removable extension 115, such that the extension 115 may be used to pry open the retaining ring 100 to create a gap for items to pass. In one embodiment, the notch 104 is positioned in a portion of the material opposite an overlapping portion of the first end 110 with a loop 102 of the retaining ring 100 and generally perpendicular to a plane formed by the loop 102. A force 120 applied to the removable extension 115 in a direction away from the loop 102 may lift the first end 110 away from the loop 102 to create the gap. The directional force 120 away from the loop 102 is such that the force 120 does not exploit any weaknesses in the retaining ring 100 created by the notch 104, such that when the directional force 120 is applied, a portion of the retaining ring 100 is separated from the rest of the retaining ring 100 to create a gap or opening through which items may pass onto or off of the retaining ring 100. In other embodiments, a force in a direction other than away from the loop 102 may create a gap in the retaining ring 100 to allow items to pass.

After inserting one or more items onto the retaining ring 100, or at any time desired by the user, the removable extension 115 may be removed so that the retaining ring 100 becomes similar to conventional retaining rings. In one embodiment, a force 122 applied to the removable extension 115 in a direction opposite the position of the notch 104 breaks the removable extension 115 away from the retaining ring 100. In some embodiments, the notch 104 may be configured such that the removable extension 115 breaks away cleanly, leaving no sharp edges on the retaining ring 100. In some embodiments, the removable extension 115 may be configured to break away by applying a force in a direction other than opposite the position of the notch 104.

In some embodiments, the loop 102 of the retaining ring 100 may form an uneven plane, such that the retaining ring material may include curved portions proximate the first end 110 and/or the second end 110 to form a tight junction between the loop 102 and the first end 110 and/or the second end 110.

Figure 2:
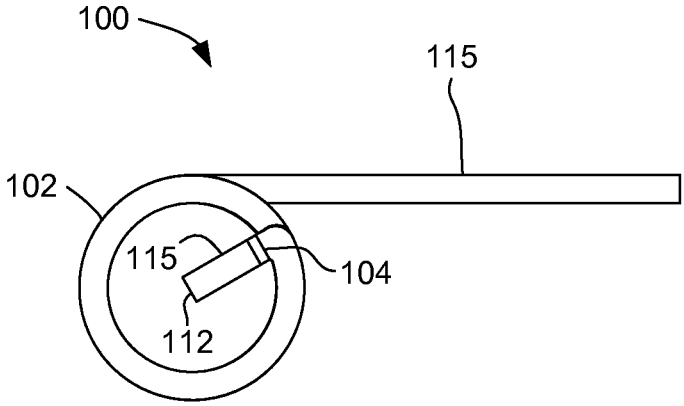
FIG. 2 depicts an illustrative diagram of one embodiment of a retaining ring, according to principles described herein.

FIG. 2 depicts an illustrative diagram of one embodiment of a retaining ring 100, according to principles described herein. The retaining ring 100 may include more than one removable extension 115. In one embodiment, the retaining ring 100 includes a removable extension 115 at the first end 110 and the second end 110 of the ring 100. In one embodiment, the removable extension 115 at the second end 110 extends radially inward toward a center of the loop 102.

A removable extension 115 toward a center of the loop 102 may allow for easier removal of items from the retaining ring 100. Because retaining rings 100 often include tight junctures or overlapping portions that require a significant amount of force to separate, removing items from a retaining ring 100 may be as difficult as inserting items onto a retaining ring 100. A notch 104 may also be positioned at the base of the removable extension 115 pointing inward such that the extension 115 may be removed, if desired. The removable extension 115 may also be used to lift a portion of the second end 110 of the retaining ring 100 to create a gap that facilitates removal of items from the retaining ring 100.

In some embodiments, the retaining ring 100 may include removable extensions 115 at each end that both extend either outward or inward, or one extension 115 that extends inward and another extension 115 that extends outward. In some embodiments, the removable extensions 115 extend only partially inward or partially outward. In one embodiment, a removable extension 115 extends tangentially away from the loop 102. In other embodiments, the removable extension 115 extends perpendicular to a tangent of the loop 102.

Figure 3:
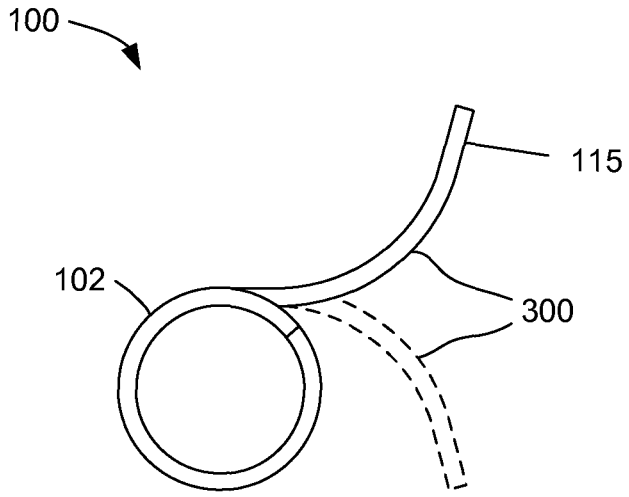
FIG. 3 depicts an illustrative diagram of one embodiment of a retaining ring, according to various embodiments of principles described herein.

FIG. 3 depicts an illustrative diagram of one embodiment of a retaining ring 100, according to various embodiments of principles described herein. In one embodiment, the retaining ring 100 has a removable extension 115 that includes a curvature 300 away from the loop 102. In another embodiment, the retaining ring 100 has a removable extension 115 that includes a curvature 300 toward the loop 102. Either embodiment may be used according to the desired purpose. The curvature 300 in the extension 115 may produce extra clearance between the retaining ring 100 and the extension 115 to facilitate placement of materials onto the retaining ring 100. The deviation of the extension 115 may include a gentle curve or an abrupt angle. The curved extension 115 may make placement of items onto the retaining ring 100 easier in some circumstances.

Figure 4:
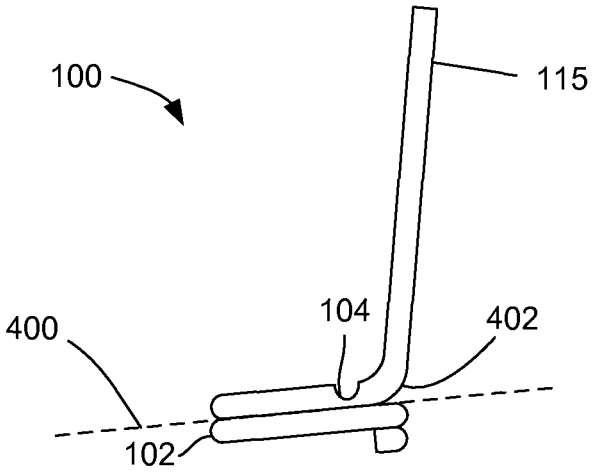
FIG. 4 depicts an illustrative diagram of one embodiment of a retaining ring, according to various embodiments of principles described herein.

FIG. 4 depicts an illustrative diagram of one embodiment of a retaining ring 100, according to various embodiments of principles described herein. In one embodiment, the removable extension 115 may extend upward from the loop 102, such that the extension 115 extends away from a plane 400 formed by the loop 102. The retaining ring 100 may include a bend 402 at the base of the removable extension 115 that directs the removable extension 115 away from the loop 102. In some embodiments, the notch 104 is positioned on the loop 102 before the bend 402 in the removable extension 115. In other embodiments, the notch 104 may be positioned at the bend 402 or past the bend 402. Applying a force upward along the angle of the removable extension 115 will produce a gap that can be beneficial in putting materials onto a retaining ring.

Figure 5:
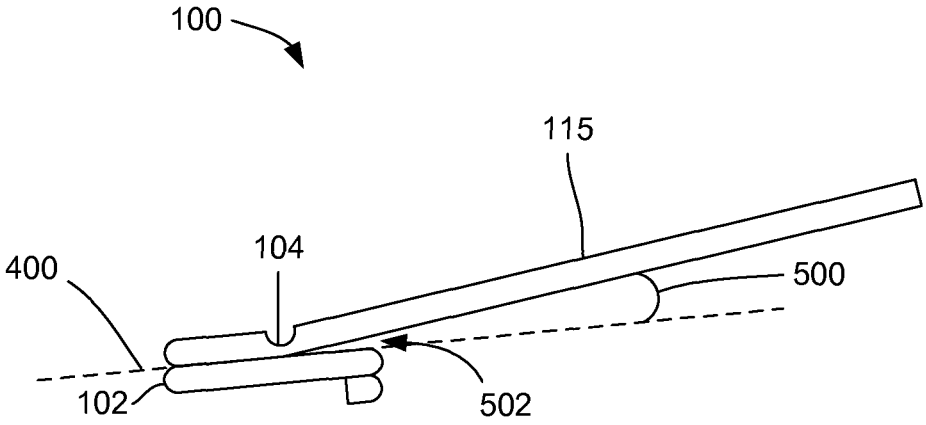
FIG. 5 depicts an illustrative diagram of one embodiment of a retaining ring, according to various embodiments of principles described herein.

FIG. 5 depicts another illustrative diagram of one embodiment of a retaining ring 100 having a removable extension 115 that extends away from the plane 400 formed by the loop 102 at an angle 500. The angle 500 at which the removable extension 115 extends from the plane 400 may be a small angle 500 to create an opening 502 or clearance for items to pass onto the retaining ring 100. A small amount of clearance may be sufficient to allow items to pass. Once a portion of the item is placed in the opening 502, the item may act as a wedge to create further clearance for the rest of the item that needs to pass in order for the item to be retained on the retaining ring 100.

Figure 6:
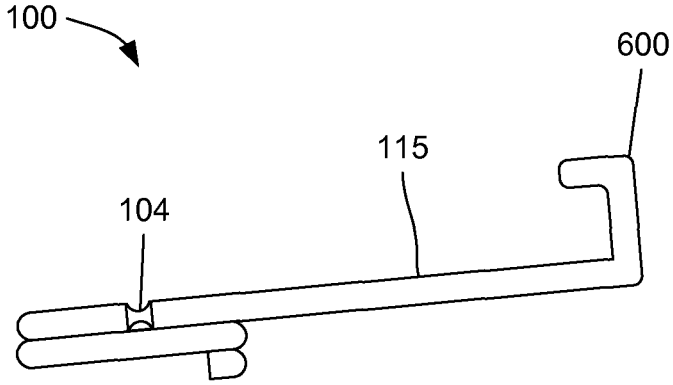
FIG. 6 depicts an illustrative diagram of one embodiment of a retaining ring, according to principles described herein.

FIG. 6 depicts an illustrative diagram of one embodiment of a retaining ring 100, according to principles described herein. In one embodiment, the removable extension 115 includes a handle 600 that facilitates removal of the removable extension 115. The handle may allow a user to better grip the extension 115 so that the user is able to apply sufficient force to break the extension 115 from the retaining ring 100. Alternatively, the handle may be formed as part of the removable extension 115 by manufacturing a bend at the end of the removable extension 115. The handle 600 may take any form, including an "L" shape, a half-circle, a loop, a "U" shape, or any other shape that may allow a user to easily grip the handle to remove the removable extension 115. In one embodiment, the handle 600 is attached to the removable extension 115 during manufacture of the retaining ring 100, and may be made of any material that allows the user to grip the handle.

In some embodiments, the notch 104 may be formed as an annular groove in the material, such that the groove extends 360 degrees around the circumference of the ring material. In this configuration, the removable extension 115 may be broken away from the retaining ring 100 by applying a force to the end of the extension 115 at any angle because the notch 104 extends around the entire circumference of the retaining ring material at the base of the removable extension 115. This allows the force applied at any angle to be able to exploit weaknesses in the ring material produced by the notch 104. In some embodiments, the retaining ring 100 may include several notches 104 proximate the removable extension 115. Multiple notches 104 may provide further exploitation points in the ring material to allow easier removal of the removable extension 115.

Figure 7:
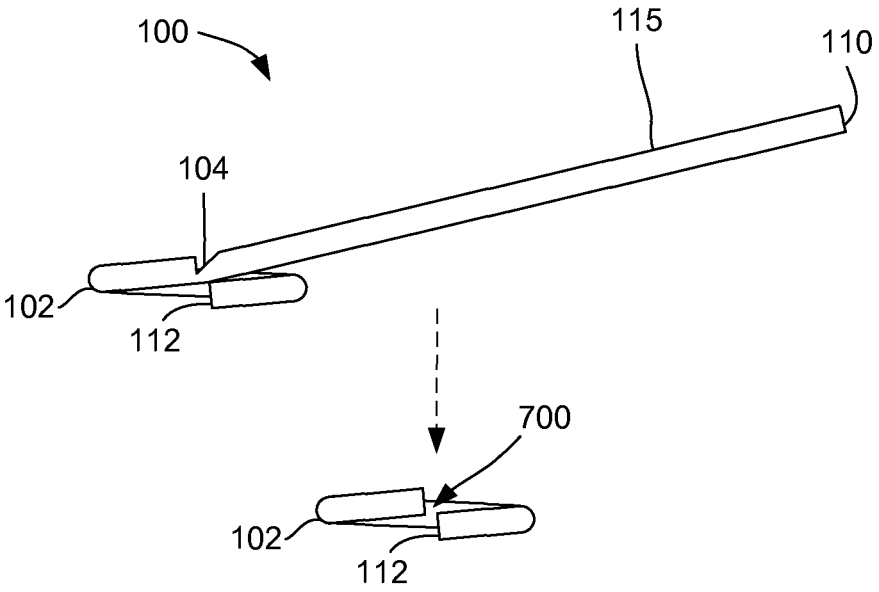
FIG. 7 depicts an illustrative diagram of one embodiment of a retaining ring, according to principles described herein.

FIG. 7 depicts an illustrative diagram of one embodiment of a retaining ring 100, according to principles described herein. The retaining ring 100 may only include one loop 102 between the first end 110 and the second end 110, such that only a small portion or none of the retaining ring 100 has overlapping portions. In some embodiments, the removable extension 115 is the only portion of the retaining ring 100 that overlaps with the second end 110 of the retaining ring 100, such that when the removable extension 115 is removed, the first end 110 of the retaining ring 100 does not overlap at all with the second end 110, but instead creates a tight junction 700, such as in what is generally known as a jump ring. A tight junction 700 may be difficult for items to pass through if the items are larger than the width of the tight junction 700 and the retaining ring material is made of a very resilient material. The removable extension 115 may be leveraged to create a sufficiently large gap through which items may pass onto the retaining ring 100.

The notch 104 may be shaped in any way suitable to the particular retaining ring 100. In some embodiments, the notch 104 may be a wedge shape that may allow the removable extension 115 to be broken away at a certain point of the retaining ring 100. In other embodiments, the notch 104 may be a round shape that may allow the removable extension 115 to be broken away within a given location range of the retaining ring 100. In other embodiments, the notch 104 may be other shapes or in other configurations so that the removable extension 115 breaks away in other ways.

Figure 8:
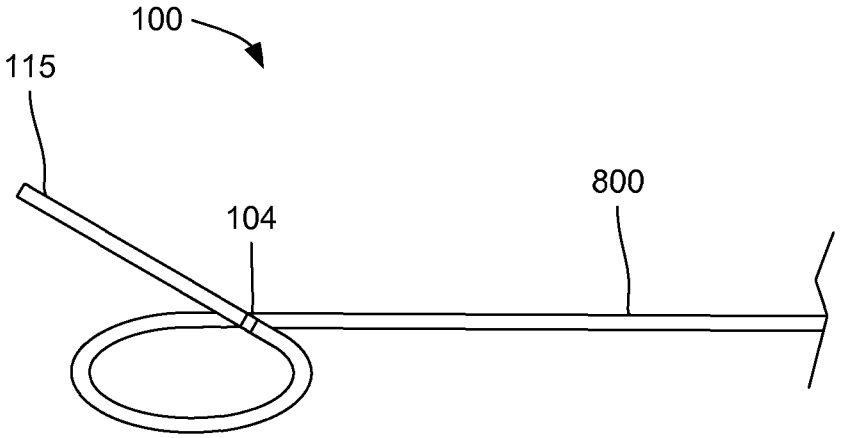
FIG. 8 depicts an illustrative diagram of one embodiment of a retaining ring, according to principles described herein.

FIG. 8 depicts an illustrative diagram of one embodiment of a retaining ring 100, according to principles described herein. An end of the retaining ring 100 may connect or be attached to another component 800 such as a needle, hook, bead stringer, jewelry, or other apparatus. For example, the retaining ring 100 may be part of a fishing hook configured to connect to a lure using the retaining ring 100. The connection from the lure may be inserted onto the retaining ring 100 of the fishing hook using the removable extension 115. When the lure is fully on the retaining ring 100, the removable extension 115 may be removed, and the lure is then firmly connected to the hook. In another embodiment, the retaining ring 100 may be attached to another apparatus.

Figure 9:
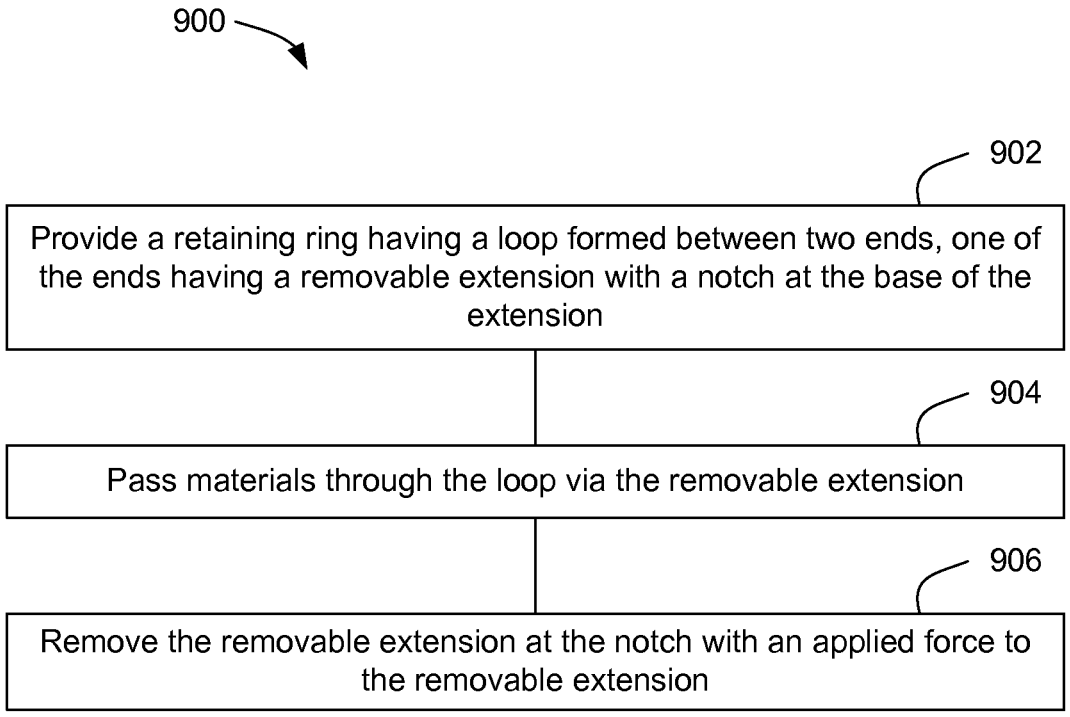
FIG. 9 depicts a flow chart diagram of one embodiment of a method for inserting items onto or removing items from a retaining ring, according to principles described herein.

FIG. 9 depicts a flow chart diagram of one embodiment of a method 900 for inserting items onto or removing items from a retaining ring 100, according to principles described herein. While the method 900 is described in connection with the retaining ring 100 described herein, the method 900 may be used with other retaining rings 100.

The method 900 includes providing 902 a retaining ring 100 that has a loop 102 formed between two ends, such as a split ring or a jump ring, and a removable extension 115 at one end. In some embodiments, the retaining ring 100 may have a removable extension 115 at both ends. The retaining ring 100 includes a notch 104 proximate a base of the removable extension 115. The notch 104 is a groove through a portion of the retaining ring material. The notch 104 may be any shape configured to provide an exploitable weakness in the material. The removable extension 115 is configured to break away from the end of the retaining ring 100 with an applied force to the removable extension 115. The retaining ring 100 may be manufactured by any method to include the removable extension 115. In some embodiments, the removable extension 115 may be connected to the rest of the material after the retaining ring 100 has been manufactured.

In some embodiments, the retaining ring 100 includes an overlapping portion between the ends. In some embodiments, the retaining ring 100 includes more than one loop 102 between the ends. In one embodiment, the removable extension 115 extends inward toward a center of the loop 102. In one embodiment, the removable extension 115 extends outward from the loop 102.

A user is able to pass 904 items through the loop 102 via the removable extension at the end where the removable extension 115 is attached. In some embodiments, the removable extension 115 provides an opening 502 of some size at the end of the ring 100 to allow easier insertion of materials or items onto the loop 102. The opening 502 may be created by forming a curvature 300 or bend 402 into the removable extension 115, or extending the removable extension 115 at an angle relative to a plane formed by the loop 102. A removable extension 115 that extends outward may be useful for inserting materials onto the retaining ring 100, while a removable extension 115 that extends inward toward the center of the loop 102 may be useful for removing materials from the retaining ring 100, though there may be alternative embodiments that use other configurations.

At any time, or after the desired materials or items have been inserted or removed from the retaining ring 100, the removable extension 115 may then be removed 906 by applying a force 122 to the removable extension 115. The applied force 122 exploits the weakness in the retaining ring material and allows a user to break the removable extension 115 away from the ring 100. The retaining ring 100 may include more than one notch 104, in some embodiments. In some embodiments, the removable extension 115 includes a gripping handle 600 that provides a gripping surface for the user to more easily grab and remove the extension 115. In other embodiments, the retaining ring 100 includes more than one removable extension 115 with at least one notch 104 at the base of each removable extension 115.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A retaining ring comprising:

a resilient material forming a loop comprising a first end and a second end, wherein the first end of the loop comprises a notch through a portion of a thickness of the material;

a removable extension at the first end, the removable extension beginning at the loop and extending in a direction away from the loop, wherein the notch is at a base of the removable extension where the removable extension begins to extend away from the loop, wherein the removable extension is configured to be broken off of the retaining ring at the notch with an applied force to the removable extension.

2. The retaining ring of claim 1, wherein the first end further comprises an overlapping portion that at least partially overlaps the second end.

3. The retaining ring of claim 1, wherein the first end forms a tight junction with the second end without the first and second end overlapping.

4. The retaining ring of claim 1, wherein the removable extension extends inward toward a center of the loop.

5. The retaining ring of claim 1, wherein the removable extension extends outward from the loop.

6. The retaining ring of claim 1, wherein the removable extension comprises a gripping handle.

7. The retaining ring of claim 1, wherein the removable extension is curved.

8. The retaining ring of claim 1, wherein the removable extension extends at an angle to a plane formed by the loop.

9. The retaining ring of claim 1, wherein the notch extends around a circumference of the resilient material, forming a ring groove around the resilient material.

10. The retaining ring of claim 1, further comprising:

a second notch at the second end of the resilient material; and a second removable extension at the second end extending from the second notch, wherein the second removable extension is configured to be removed from the retaining ring at the second notch with an applied force to the second removable extension.

11. A retaining ring comprising:

a metal loop comprising a tight junction for passing materials, wherein an end of the loop comprises a notch through a portion of a thickness of the metal;

a removable extension at the end of the loop, the removable extension beginning at the loop and extending in a direction away from the loop, wherein the notch is at a base of the removable extension where the removable extension begins to extend away from the loop, wherein the removable extension is configured to break off of the retaining ring at the notch with an applied force to the removable extension, wherein the loop is configured to retain items placed on the loop after removal of the removable extension.

12. A method for inserting items onto or removing items from a retaining ring, comprising:

providing a retaining ring, wherein the retaining ring comprises:

a resilient material forming a loop comprising a first end and a second end, wherein the first end of the loop comprises a notch through a portion of a thickness of the material; and a removable extension at the first end, the removable extension extending in a direction away from the loop, wherein the notch is at a base of the removable extension where the removable extension begins to extend away from the loop;

passing materials through the loop via the removable extension at the first end; and breaking the removable extension off of the retaining ring at the notch with an applied force to the removable extension.

13. The method of claim 12, wherein the first end of the resilient material comprises an overlapping portion that at least partially overlaps the second end.

14. The method of claim 12, wherein the removable extension extends inward toward a center of the loop.

15. The method of claim 12, wherein the removable extension extends outward from the loop.

16. The method of claim 12, wherein the removable extension comprises a gripping handle.

17. The method of claim 12, wherein the removable extension is curved.

18. The method of claim 12, wherein the removable extension extends at an angle to a plane formed by the loop.

19. The method of claim 12, wherein the retaining ring further comprises:

a second notch at the second end of the resilient material; and a second removable extension at the second end extending from the second notch, wherein the second removable extension is configured to be removed from the retaining ring at the second notch with an applied force to the second removable extension.

20. The method of claim 12, wherein inserting materials onto the loop further comprises applying a directional force to the removable extension that does not exploit weaknesses created by the notch, wherein the directional force creates an opening in the loop without removing the extension.

* * * * *